United States Patent [19]

Takeuchi et al.

[11] 4,327,991

[45] May 4, 1982

[54] TRANSFER PAPER STRIPPER

[75] Inventors: Osamu Takeuchi; Satoshi Chiba; Satoru Komiya; Satoshi Komatsu; Kazuo Asada; Yuji Tokashiki; Hiroshi Shimazaki, all of Ebina, Japan

[73] Assignee: Xerox Corporation, Stamford, Conn.

[21] Appl. No.: 130,776

[22] Filed: Mar. 17, 1980

[30] Foreign Application Priority Data

Mar. 30, 1979 [JP] Japan ..... 54-040710

[51] Int. Cl.[3] ..... G03G 15/00

[52] U.S. Cl. ..... 355/3 SH; 271/308; 271/312; 355/3 TR

[58] Field of Search ..... 355/3 R, 3 SH, 3 TR, 355/14 SH; 271/307, 308, 312, DIG.2

[56] References Cited

U.S. PATENT DOCUMENTS

| | | | |
|---|---|---|---|
| 3,450,402 | 6/1969 | Weiler | 271/308 |
| 3,912,256 | 10/1975 | Nagahara | 271/DIG. 2 |
| 3,955,889 | 5/1976 | Ishiguro et al. | 355/3 R |
| 3,981,085 | 9/1976 | Franko | 271/DIG. 2 |
| 4,004,802 | 1/1977 | Brooke | 271/308 |
| 4,060,320 | 11/1977 | Doi et al. | 355/3 TR |
| 4,062,631 | 12/1977 | Ichikawa et al. | 271/308 X |

*Primary Examiner*—Fred L. Braun

[57] ABSTRACT

Sheet stripping apparatus for removing sheets from an imaging member having a light sensitive layer thereon and a band-like elastomeric layer carried by the imaging member adjacent one end thereof contiguous the light sensitive layer. A cam member is adapted for pressure engagement with the elastomeric layer through a transfer paper in contact therewith such that the lead edge of the transfer paper is lifted from the imaging member.

3 Claims, 6 Drawing Figures

TRANSFER PAPER STRIPPER

DETAILED DESCRIPTION OF THE INVENTION

This invention concerns a device for stripping a transfer paper from the surface of a light sensitive drum in a transfer type reproducing machine.

Conventional transfer paper strippers of this type known so far include those of a structure, wherein a light sensitive drum A is constituted by providing an elastomeric layer c between a drum body a and a light sensitive layer b along the entire longitudinal surface as shown in FIG. 1, and adapted to urge a roller d to the light sensitive layer b to resiliently deform the light sensitive layer b and the elastomeric layer c by its urging force, thereby causing the leading portion of the transfer paper e after transfer to sink into the elastomeric layer c of the light sensitive drum A by said roller d and lifts the leading portion of the transfer paper e to strip it from the light sensitive drum A as shown in FIG. 2.

The stripper of such a structure has, however, disadvantages due to the structure of the light sensitive drum A providing the elastomeric layer c between the drum body a and the light sensitive layer b along the entire longitudinal surface, in that the elastomeric layer c requires a lot of constituting materials to increases cost and need very irksome fabrication, as well as the picture quality is degraded since the roller d presses the image region in the light sensitive drum A.

Moreover, it has also a disadvantage of poor durability since the roller d always urges the light sensitive layer b.

This invention has been made in view of the foregoings and the object thereof is to provide a transfer paper stripper that can be fabricated at a reduced cost and with ease, and can improve the durability and reduce the degradation of the image quality in the image region.

BRIEF DESCRIPTION OF THE DRAWINGS

FIG. 1 and FIG. 2 show conventional examples, wherein

FIG. 1 is a perspective view of a light sensitive drum and

FIG. 2 is a schematic front elevational view thereof, and

FIG. 3 and succeeding figures show one embodiment of this invention, wherein FIG. 3 is a perspective view of a light sensitive drum.

Figure 1:
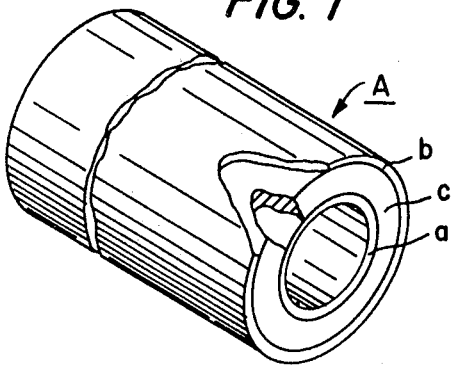
Figure 2:
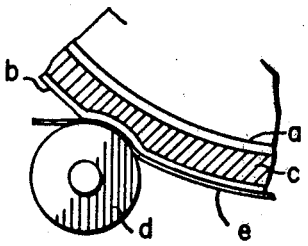
Figure 3:
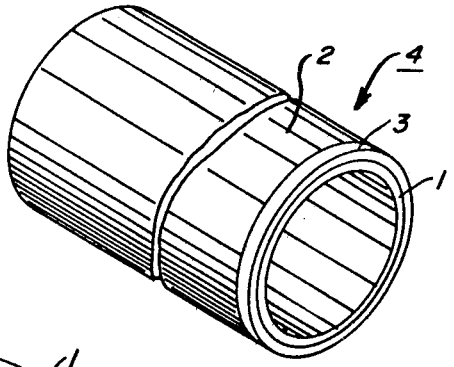
Figure 4:
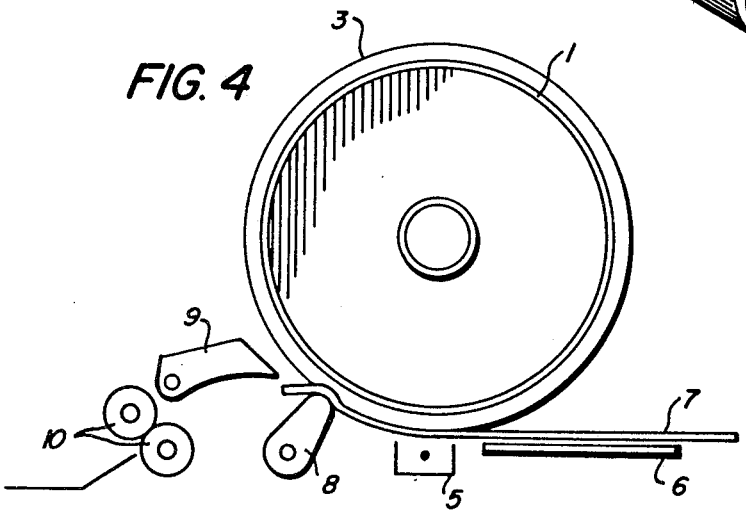
FIG. 4 is a schematic front elevational view.

This invention is to be described by way of its embodiment referring to FIG. 3 and succeeding figures.

FIG. 3 is a perspective view of a light sensitive drum according to this invention, wherein a light sensitive drum 4 is formed by providing a light sensitive layer 2 to a drum main body 1 approximately over the entire longitudinal area, and providing an elastomeric layer 3 in a band-like manner to one longitudinal end where the light sensitive layer 2 is not formed (non-image region).

A transfer corotron 5 is provided opposing to the light sensitive drum 4 and it is adapted to transfer toner images on a transfer paper 7 is transported along a guide plate 6. A stripper cam 8 is disposed, to the downstream of the transfer corotron 5 in the transporting direction of the transfer paper 7 and near the surface of the light sensitive drum 4, rotatably between a position urging the elastomeric layer 3 and a position aparting therefrom, and a guide member 9 and a separation roller 10 are successively disposed to the downstream of the cam 8 so as to apart from the light sensitive drum 4.

Figure 5:
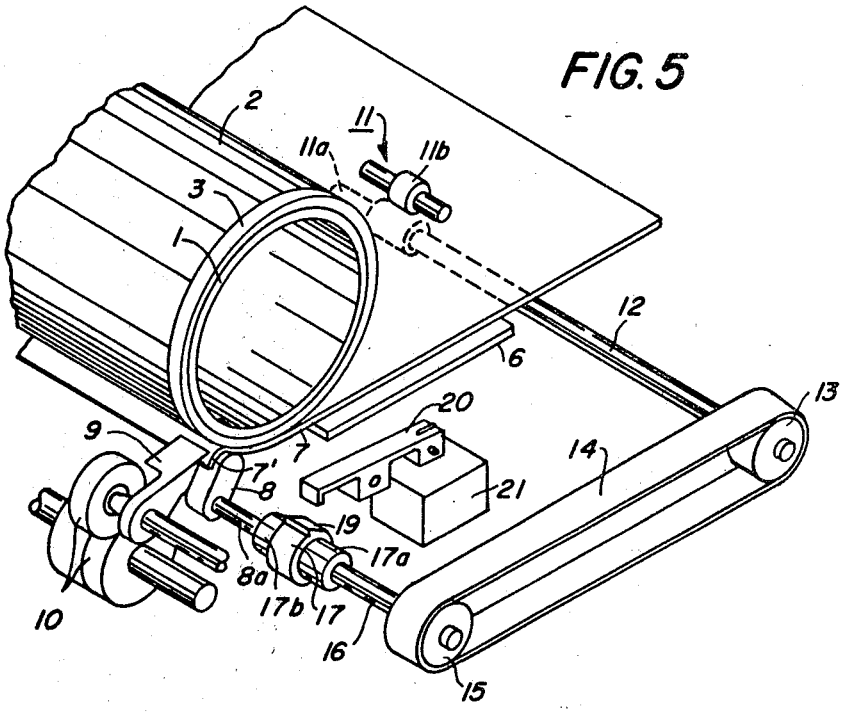
FIG. 5 is a detailed perspective view.

In FIG. 5, reference numeral 11 denotes a send roller for sending out the transfer paper 7 and it comprises a driving roller 11*a* and a driven roller 11*b* urged to each other and contacting the upper and the lower surfaces of the transfer paper 7 respectively, in which the driving roller 11*a* is provided to a driving shaft 12, which is operationally coupled by way of a pulley 13, a belt 14 and a pulley 15 to a rotational shaft 16, which is, in turn, rotationally coupled by way of a clutch 17 to the support shaft 8*a* of the cam 8.

The clutch 17 is formed by connecting a driving side 17*a* and a driven side 17*b* through a spring or the like and adapted to be set to a non-transmission state if the driven side 17*b* is fixed and to a transmission state if the driven side b is made free. A projection 19 is provided to the driven side 17*b*, a lever 20 is provided at a position near the projection 19 for engaging therewith and the lever 20 is connected to a plunger 21 in such a manner that the lever 20 moves to its lower position for engaging the projection 19 to set the clutch 17 into the non-transmission state (disconnection) during non-energization of the plunger 21 and moves to its upper position for aparting from the projection 19 to set the clutch 17 into the transmission condition (connection) upon energization of the plunger 21.

The plunger 21 is adapted such that it may be energized by the reception of an electric signal when the leading portion of the transfer paper 7 after transfer proceeds between the elastomeric layer 3 and the cam 8.

Figure 6:
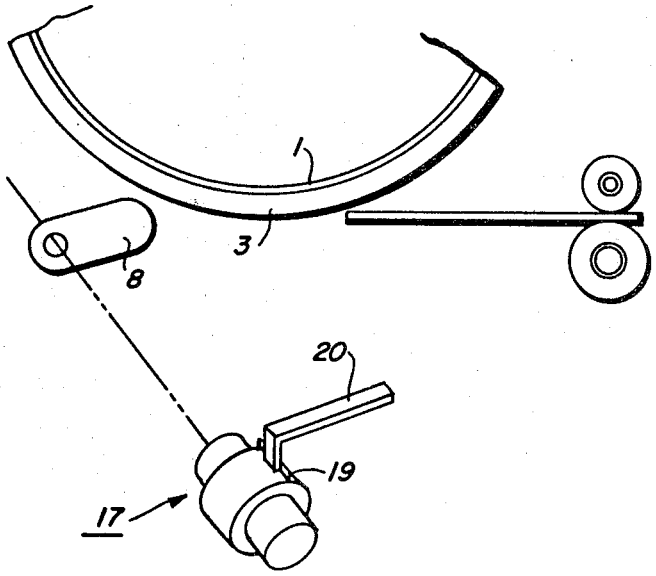
FIG. 6 is a schematic front elevational view for the explanation of the operation.

The cam 8 is mounted to the support shaft 8*a* in such a way that it slightly aparts from the elastomeric layer 3 when the clutch 17 is in disconnection and takes the urging position by a slight rotation (refer to FIG. 6).

The operation is to be described.

The transfer paper 7 is sent out by the roller 11 and transported in the direction of the light sensitive drum 4 along the guide plate 6. The plunger 21 is then in the non-energized state wherein the lever 20 moves downward to engage the projection 19 thereby keep the clutch 17 disconnected (the state shown in FIG. 6).

Consequently, the rotation of the driving shaft 12 is not transmitted to the support shaft 8*a* of the cam 8 and the cam 8 stops at its status (position).

Then, when the transfer sheet 7 is further transported along the guide plate 6, it contacts the surface of the light sensitive drum 4 (the light sensitive layer 2 and the elastomeric layer 3) and the toner images on the light sensitive drum 4 are transferred by the transfer corotron 5.

The transfer paper 7 after the transfer advances to a gap between the elastomeric layer 3 and the cam 8. Then, the lever 20 is moved to its upper position aparting from the projection 19 by an electric signal sent to the plunger 21 by an adequate means to energize it, whereby the clutch 17 is connected and the rotation of the roller 11 is transmitted to the support shaft 8*a* of the cam 8. The cam 8 thus rotates in timing with the advance of the transfer paper 7 and is urged to the elastomeric layer 3 together with the transfer paper 7 causing the elastomeric layer 3 to deform resiliently and leap up the leading side 7′ of the transfer paper 7 thereby conducting stripping.

The stripped leading side portion 7′ of the transfer paper 7 proceeds along the guide member 9 into separation roller 10 and the transfer paper 7 is gradually separated and stripped from the surface of the light sensitive drum 4 by the urging and rotating force of the separation roller 10.

As foregoings, the transfer paper 7 can be stripped from the surfaceof the light sensitive drum.

Moreover, since the elastomeric layer 3 is provided only in the non-image forming region on one longitudinal end, the amount of materials therefor can be depressed to lower the cost, as well as facilitate the fabrication.

In addition, since the cam 8 is urged to the elastomeric layer 3 only in the stripping of the transfer paper 7, the durability can be improved.

Further, since the cam 8 is urged only to the non-image region, the degradation for the image quality in the image region can be reduced and the elastomeric layer 3 can be replaced with ease if damaged or deformed.

This invention, having the foregoing constitutions, can provide a transfer paper stripper which can be fabricated at a reduced cost and with ease, as well as improve the durability.

In addition, since the cam 8 is urged only to the elastomeric layer 3 formed on the circumferential surface of the side end of the light sensitive drum 4, the image quality degradation in the image region can be decreased.

3. . . elastomeric layer
4. . . light sensitive drum
5. . . transfer corotron
7. . . transfer paper
7′. . . lead side portion
8. . . cam
9. . . guide member

We claim:

1. Sheet stripping apparatus for use in removing sheets from an imaging member having a light sensitive layer thereon, said apparatus comprising:

a band-like elastomeric layer carried by said imaging member adjacent one end thereof contiguous said light sensitive layer;

means for transporting transfer papers into contact with said light sensitive layer and said band-like elastomeric layer; and means for contacting said transfer paper and deforming said band-like elastomeric layer through said transfer paper thereby causing the lead edge of said transfer paper to lift off said imaging member.

2. Apparatus according to claim 1 wherein said deforming means comprises a cam member movable between contacting and non-contacting positins with said transfer paper, said apparatus further including means for moving said cam member to said positions in a predetermined manner.

3. Apparatus according to claim 2 including a guide member and a pair of separation rolls cooperating to separate said transfer paper from said imaging member.

* * * * *

UNITED STATES PATENT AND TRADEMARK OFFICE

CERTIFICATE OF CORRECTION

PATENT NO. : 4,327,991

DATED : May 4, 1982

INVENTOR(S) : O. Takeuchi, S. Chiba et al.

It is certified that error appears in the above-identified patent and that said Letters Patent is hereby corrected as shown below:

On the title page, assignee should read

-- (73) Rank Xerox Limited, London, England --.

Signed and Sealed this

*Eighteenth* Day of *January 1983*

[SEAL]

*Attest:*

GERALD J. MOSSINGHOFF

*Attesting Officer*

*Commissioner of Patents and Trademarks*